US006194372B1

(12) United States Patent
Picken, Jr. et al.

(10) Patent No.: US 6,194,372 B1
(45) Date of Patent: Feb. 27, 2001

(54) SOLVENT BASED SPRAYABLE GEL

(75) Inventors: Henry M. Picken, Jr., Kennesaw; Euguene Schaffstall, Dunwoody, both of GA (US)

(73) Assignee: Beaumont Products, Inc., Kennesaw, GA (US)

( * ) Notice: Subject to any disclaimer, the term of this patent is extended or adjusted under 35 U.S.C. 154(b) by 0 days.

(21) Appl. No.: 09/387,222

(22) Filed: Aug. 31, 1999

Related U.S. Application Data

(60) Provisional application No. 60/109,161, filed on Nov. 20, 1998.

(51) Int. Cl.[7] ..... C11D 17/00; C11D 17/08; C11D 3/02; C11D 3/38

(52) U.S. Cl. ..... 510/403; 510/420; 510/421; 510/463; 510/507

(58) Field of Search ..... 510/403, 507, 510/420, 421, 462, 463

(56) References Cited

U.S. PATENT DOCUMENTS 4,051,056 * 9/1977 Hartman ..... 252/99
4,315,828 * 2/1982 Church ..... 252/153
4,436,637 * 3/1984 Bayless ..... 252/171
5,688,435 * 11/1997 Chang et al. ..... 252/187.25
5,853,730 * 12/1998 Picken ..... 424/195.1
5,858,945 * 1/1999 Lang et al. ..... 510/224
5,910,529 * 6/1999 Wollner ..... 524/394

OTHER PUBLICATIONS

McCutcheon's vol. 1: Emulsifiers & Detergents (1993) North American Edition, p. 191.*

* cited by examiner

*Primary Examiner*—Yogendra Gupta
*Assistant Examiner*—John M Petruncio
(74) *Attorney, Agent, or Firm*—James W. Kayden; Thomas, Kayden Horstemeyer & Risley

(57) ABSTRACT

The present invention is a sprayable gel cleaning composition and method for producing the same that can be used to remove household and industrial spots and stains that are often present on walls, cabinets, stove tops, doors, and trim. In addition, this invention can be used to clean bug and tar stains present on automobiles, trucks, and other machinery. The sprayable gel cleaning composition is made of a solution and a gel-forming material capable of forming a gel when placed with the solution. The gel is capable of liquefying and also capable of reforming a gel when applied to a surface. The solution is composed of citrus water distillate, a solvent, a surfactant, and a terpene compound. The gel-forming material is composed of a montmorillonite or synthetic clay.

22 Claims, No Drawings

SOLVENT BASED SPRAYABLE GEL

This application claims the benefit of Provisional Ser. No. 60/109,161 filed Nov. 20, 1998.

BACKGROUND OF THE INVENTION

Household and industrial spots and stains are unattractive and can damage paint finishes on household surfaces, automobiles, trucks, machines, wood, siding, and other surfaces. It is desirable to clean these types of stains in an economical manner. Many spray cleaners have limited contact times because they tend to run down the surface and/or the solvent may evaporate. Running exacerbates the problem by spreading the stain and causing streaks to appear on the surface. Consequently, several applications may be required to remove the stain. Additionally, one of the major components of many spray cleaners is distilled or deionized water. The production of distilled water involves essentially the evaporation and later collection of pure water away from the impurities contained within the impure water. Deionization of water involves the removal of charged particles from water by bringing it in contact with some reacting, deionizing material. These processes require time expenditure and energy consumption and thus add to the cost of product preparation.

An example of the use of a particular type of pure water is found in U.S. Pat. Nos. 5,741,481 and 5,853,730, to Picken. These patents teach the use of citrus water distillate, produced as orange juice is made into concentrate. Such use of a previously unused resource reduces the cost of product preparation and provides additional advantages due to components found in the distillate itself.

The Church patent, U.S. Pat. No. 4,315,828, teaches the use of a cleaning compound that is composed mainly of water and contains a minor cleaning component such as ammonium hydroxide or a lower alcohol.

The Bayless patent, U.S. Pat. No. 5,330,673, teaches the use of a cleaning compound that is composed of 80–97.5% d-limonene and 2.5–20% of cocamide DEA/dihexyl sodium sulfosuccinate.

Therefore there is a need in the art for a cleaner that is expelled from the container in mist or liquid form, which, upon contact with a surface, forms a gel material capable of retaining its shape for a more than brief period of time. Such a gel material would be advantageous in that instead of evaporating quickly or running off, it would allow extended contact time with the dirty and/or stained surface, thereby more quickly and effectively cleaning the surface and breaking down the stain. It is to meet this and other heretofore unmet needs that the present invention is directed.

SUMMARY OF THE INVENTION

The present invention is a sprayable gel cleaning composition that can be used to clean household and industrial spots and stains that are often present on walls, cabinets, stove tops, trim, automobiles and trucks. In addition, this invention can be used to clean bug and tar stains present on automobiles, trucks, construction machinery and other machinery that becomes stained.

The sprayable gel cleaning composition is made of a solution and a gel-forming material capable forming a gel when mixed with the solution. The gel is capable of liquefying upon agitation, shearing, or by forcing the product through a spray nozzle or other small orifice to form droplets, for example, as in an aerosol application or trigger spray; but is also capable of reforming a gel once the agitation has ceased. The solution is composed of citrus water distillate, a solvent, a surfactant, a terpene compound, a coloring agent, and a preservative. The gel-forming material is composed of a montmorillonite clay. An example of a montmorillonite clay is laponite, which may be a rapid dispersing laponite.

The sprayable gel cleaning composition is made by premixing a montmorillonite clay in a portion of a solvent forming a premix-clay/solvent. Also, a terpene and a surfactant are premixed to form a premix-terpene/surfactant. Both premixes are added and mixed in a mixing tank that contains a citrus water distillate. Further, add a coloring agent, for example FD&C Yellow #5 (0.1%), to the mixing tank and mix until the composition is thoroughly mixed. The sprayable gel cleaning composition is made in large batches. A few hours before the composition is to be placed into its dispensing container, mix in a preservative. The dispensing container is a manageable spray-type container that one typically uses for these types of cleaners.

Various additional objects and advantages of the present invention will become apparent from the following detailed description.

DETAILED DESCRIPTION OF THE PREFERRED EMBODIMENT

The present invention is a sprayable gel cleaning composition that can be used to clean household and industrial spots and stains that are often present on walls, cabinets, stove tops, doors, trim, automobiles and trucks. In addition, this invention can be used to clean bug and tar stains present on automobiles, trucks, construction machinery and other machinery that becomes stained.

Many other cleaners tend to run, with the concomitant result of limited contact time. The limited contact time of other cleaners decreases their effectiveness because the active ingredients are not given enough time to break down the stain because they run off or evaporate. As a result of the limited contact time, numerous applications are required to clean the stain. Moreover, because other cleaners run, the stain can be spread, and streaks may be left even after the cleaning.

Unlike many other cleaners that have limited contact times, the present invention has a very long contact time. This is advantageous because the active agents in the cleaning composition stay in contact with the stain for a longer period of time, thus able to break down the stain with fewer applications and less effort on the part of the user of the cleaner. Further, the gel material retards evaporation and is therefore useful even on hot surfaces, such as those of an automobile or stove top.

The present invention is a sprayable gel cleaning composition. The cleaning composition is in the form of a gel while in its dispensing container. However, when the spray button or lever is activated the gel liquefies as it is sprayed. When the liquefied gel contacts the stained surface it reforms into a gel. The reformed gel is the same gel that was in the container. The gel does not run or cause streaking like other cleaners. The gel stays on the stained surface until it is wiped off. Thus, the active agents of the sprayable gel cleaning composition are in contact with the stain for a longer period of time than other cleaners.

The sprayable gel cleaning composition is made of a solution and a gel-forming material capable forming a gel when placed with the solution. The gel is capable of liquefying upon agitation but is also capable of reforming a gel once the agitation has ceased. The solution is composed of citrus water distillate, solvents, surfactants, terpene compounds, a coloring agent, and a preservative. The gel-forming material is composed of a montmorillonite clay. An example of a montmorillonite clay is Laponite RDS, which may be a rapid dispersing laponite.

Further, the sprayable gel cleaning composition is composed of about 35% by weight to about 90% by weight of a citrus water distillate; about 1% by weight to about 4% by weight of at least one montmorillonite clay; about 5% by weight to about 26% by weight of at least one solvent; about 5% by weight to about 16% by weight of at least one surfactant; about 0.5% by weight to about 10% by weight of at least one terpene compound; about 1% by weight to about 4% by weight of at least one coloring agent; and about 0.5% by weight to about 2% by weight of at least one preservative.

The sprayable gel cleaning composition is made by pre-mixing a montmorillonite clay in a portion of a solvent forming a premix-clay/solvent. The portion of solvent needed is that which is sufficient to pre-wet and disperse the montmorillonite clay. Also, premix a terpene and a surfactant to form a premix-terpene/surfactant. After premixing, add citrus water distillate to a mixing tank and start the mixer. The temperature of the citrus water distillate is about 70–90° F. Add premix clay/solvent to the mixing tank and mix until the premix-clay/solvent/citrus water distillate is clear, which is about 20 to about 30 minutes. Add the remainder of the solvent to the mixing tank and mix until the composition is thoroughly mixed. In addition, add the premix-terpene/surfactant to the mixing tank and mix until the composition is thoroughly mixed. Further, add a coloring agent, for example FD&C Yellow #5 (0.1%), to the mixing tank and mix until the composition is thoroughly mixed. About 2 to 3 hours before the composition is to be placed into its container add a preservative to the mixing tank and mix for about 2 to about 3 minutes. A sprayable gel cleaning composition is created by following the method discussed above.

The sprayable gel cleaning composition is composed of a citrus water distillate. Citrus water distillate is extremely pure, containing essentially purified water and a small amount of d-limonene, which is a component found in the rinds of citrus fruits. Citrus water distillate comprises about 35% by weight to about 90% by weight of the sprayable gel cleaning composition.

Citrus water distillate is produced during the process of concentrating citrus fruit juice, such as orange juice, lemon juice, grapefruit juice, to produce juice concentrate. Citrus fruit juice is typically concentrated so that the storage, shipping and preparation of fresh and frozen citrus products is more manageable. Typically in the industry the citrus water distillate is thrown away or is used to irrigate the citrus trees. This distillate, however, is extremely purified, having been filtered both naturally, by the citrus trees, and during the process of juice concentration. The distillate contains very low amounts of ionic and mineral components, thus it comprises "soft" water.

The sprayable gel cleaning composition is composed of at least one solvent. Solvents include, but are not limited to, the following: glycols, alcohols, dibasic esters, and other polar solvents. Additionally, solvents also include, but are not limited to, the following: ethylene glycol monomethyl ether, ethylene glycol monobutyl ether, diethylene glycol monomethyl ether, diethylene glycol monobutyl ether, propylene glycol phenyl ether, propylene glycol monomethyl ether, propylene glycol monopropyl ether, dipropylene glycol monopropyl ether, propylene glycol monobutyl ether, dipropylene glycol monobutyl ether, ethylene glycol, diethylene glycol, triethylene glycol, tetraethylene glycol, propylene glycol, dipropylene glycol, hexylene glycol, 1,2,6 hexanetriol, 1,5 pentanediol, methyl alcohol, ethyl alcohol, ethylene glycol ethyl ether, ethylene glycol isopropyl ether, diethylene glycol ethyl ether, dipropylene glycol methyl ether, tripropylene glycol methyl ether, propyl alcohol, isopropyl alcohol. The solvent comprises about 5% by weight to about 26% by weight of the sprayable gel cleaning composition.

The sprayable gel cleaning composition is composed of at least one surfactant. Surfactants include, but are not limited to, nonionic surfactants and anionic surfactants. An example of a surfactant is Tergitol 15-S-9. Many surfactants are listed in *McCutcheon's Emulsifiers and Detergents* 1999: North American Edition, Vol. 1, and are herein incorporated by reference. The surfactant comprises about 5% by weight to about 16% by weight of the sprayable gel cleaning composition.

The sprayable gel cleaning compound is also composed of one or more builders, including but not limited to potassium hydroxide, sodium hydroxide, silicate, phosphate, and ethylenediaminetetraacetic acid (EDTA).

The sprayable gel cleaning composition is composed of at least one terpene. An example of a terpene includes, but is not limited to, d-limonene. The terpene comprises about 0.5% by weight to about 10% by weight of the sprayable gel cleaning composition.

The sprayable gel cleaning composition is composed of at least one coloring agent. An example of a coloring agent is FD&C Yellow #5 (0.1%). The coloring agent comprises about 1% by weight to about 4% by weight of the sprayable gel cleaning composition.

The sprayable gel cleaning composition is composed of at least one preservative. An example of a preservative includes, but is not limited to, the following: methyl paraben, propyl paraben, DMDM hydantoin, 5-bromo-5-nitro-1,3-dioxane, 2-bromo-2-nitropropane-1,3-diol, diazolidinyl urea, imidazolidinyl urea, 5-chloro-2-methyl-4-isothiazolin-3-one, sodium hydroxy methyl glycinate, hexahydro-1,3,5-triethyl-s-triazine, chloroxylenol, and substituted diphenyl ether. The preservative comprises about 0.5% by weight to about 2% by weight of the sprayable gel cleaning composition.

The sprayable gel cleaning composition is composed of at least one montmorillonite clay which is suspended in the composition and contributes to the initial formation and reformation of the gel form. An example of a montmorillonite clay that works effectively in the instant invention is laponite. Other types of montmorillonite clay includes, but are not limited to, the following: montmorillonite, smectite, sodium montmorillonite (sodium bentonite (Wyoming bentonite (US)), swelling bentonite (Western bentonite (US), sodium-activated bentonite (bentonitte (UK)), sodium-exchanged bentonite, (synthetic bentonite)), calcium montmorillonite (calcium bentonite (Mississippi bentonite (US)), sub-bentonite (Texas bentonite (US))), magnesium montmorillonite (saponite & armargosite), potassium montmorillonite (metabentonite), and lithium montmorillonite (hectorite). The montmorillonite clay comprises about 1% by weight to about 4% by weight of the sprayable gel cleaning composition.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of the present invention and protected by the following claims.

We claim:

1. A sprayable gel cleaning composition, comprising:

a) a solution that includes:

a citrus water distillate;

at least one organic polar solvent;

at least one surfactant;

at least one builder;

at least one terpene compound in the amount of about 0.5% by weight to about 10% by weight of the composition; and b) a gel-forming material capable of forming a gel when mixed with said solution, said gel having as a characteristic the capability of liquefying upon agitation or dispersion into droplets; and reforming into a gel when at rest, wherein said material is montmorillonite clay.

2. The composition of claim 1, wherein said at least one solvent is selected from the group consisting of glycols, alcohols, and dibasic esters.

3. The composition of claim 1, wherein said at least one solvent comprises dipropylene glycol monoethyl ether.

4. The composition of claim 1, wherein said at least one surfactant is selected from the group consisting of nonionic surfactants and anionic surfactants.

5. The composition of claim 1, wherein said at least one surfactant comprises a $C_{11-C15}$secondary ethoxylate nonionic surfactant having an HLB of 13.3.

6. The composition of claim 1, wherein said at least one builder is selected from the group consisting of potassium hydroxide, sodium hydroxide, silicate, phosphate, and ethylenediaminetetraacetic acid.

7. The composition of claim 1, wherein said at least one terpene compound comprises d-limonene.

8. The composition of claim 1, further comprising at least one preservative, wherein said at least one preservative is selected from the group consisting of methyl paraben, propyl paraben, DMDM hydantoin, 5-bromo-5-nitro-1,3-dioxane, 2-bromo-2-nitropropane-1,3-diol, diazolidinyl urea, imidazolidinyl urea, 5-chloro-2-methyl-4-isothiazolin-3-one, sodium hydroxy methyl glycinate, hexahydro-1,3,5-triethyl-s-triazine, chloroxylenol, and substituted diphenyl ether.

9. The composition of claim 1, herein said montmorillonite clay comprises laponite.

10. The composition of claim 9, wherein said laponite is rapid dispersing.

11. A sprayable gel cleaning composition, comprising:

a) a solution that includes:

a citrus water distillate;

at least ones organic polar solvent selected from the group consisting of glycols, alcohols, dibasic esters, and dipropylene glycol monoethyl ether;

at least one surfactant selected from the group consisting of nonionic surfactants and anionic surfactants;

at least one builder;

at least one terpene compound, wherein the terpene compound comprises d-limonene; and b) a gel forming material capable of forming a gel when mixed with said solution, said gel having as a characteristic the capability of liquefying upon agitation; and reforming into a gel when at rest, wherein said gel forming material includes montmorillonite clay.

12. The composition of claim 11, wherein said montmorillonite clay comprises laponite.

13. The composition of claim 12, wherein said laponite is rapid dispersing.

14. The composition of claim 11, wherein said at least one surfactant comprises a $C_{11}$–$C_{12}$secondary ethoxylate nonionic surfactant having an HLB of 13.3.

15. The composition of claim 11, further comprising at least one preservative, wherein said at least one preservative is selected from the group consisting of methyl paraben, propyl paraben, DMDM hydantoin, 5-bromo-5-nitro-1,3-dioxane, 2-bromo-2-nitropropane-1,3-diol, diazolidinyl urea, imidazolidinyl urea, 5-chloro-2-methyl-4-isothiazolin-3-one, sodium hydroxy methyl glycinate, hexahydro-1,3,5-triethyl-s-triazine, chloroxylenol, and substituted diphenyl ether.

16. A method for the preparation of a sprayable gel-based cleaning composition that is able to form a liquid and is able to reform into a gel comprising the steps of:

a) premixing at least one montmorillonite clay in a portion of at least one solvent, where said portion of at least one polar organic solvent is sufficient to pre-wet and disperse the said at least one montmorillonite clay, to form a premix-clay/solvent;

b) premixing at least one terpene and at least one surfactant to form a premix-terpene/surfactant;

c) adding a citrus water distillate to a mixing tank;

d) adding said premix clay/solvent to said mixing tank and mix until said premix-clay/solvent/citrus water distillate is clear;

e) adding the remainder of said at least one polar organic solvent to said mixing tank;

f) adding said premix-terpene/surfactant to said mixing tank for forming a sprayable gel.

17. The method of claim 16, wherein said at least one montmorillonite clay comprises laponite.

18. The method of claim 16, wherein said laponite is rapid dispersing.

19. The method of claim 16, wherein said at least one solvent is selected from the group consisting of glycols, alcohols, and dibasic esters.

20. The method of claim 16, wherein said at least one surfactant comprises a $C_{11}$–$C_{15}$secondary ethoxylate nonionic surfactant having and HLB of 13.3.

21. The method of claim 16, wherein said at least one terpene compound comprises d-limonene.

22. The method of claim 16, comprising (g) adding at least one preservative wherein said at least one preservative is selected from the group consisting of methyl paraben, propyl paraben, DMDM hydantoin, 5-bromo-5-nitro-1,3-dioxane, 2-bromo-2-nitropropane-1,3-diol, diazolidinyl urea, imidazolidinyl urea, 5-chloro-2-methyl-4-isothiazolin-3-one, sodium hydroxy methyl glycinate, hexahydro-1,3,5-triethyl-s-triazine, chloroxylenol, and substituted diphenyl ether.

* * * * *